US005901882A

United States Patent [19]

Siegel

[11] Patent Number: 5,901,882

[45] Date of Patent: May 11, 1999

[54] SQUEEZE BOTTLE WITH INSULATING JACKET

[75] Inventor: Gerald Siegel, Scottsdale, Ariz.

[73] Assignee: Auma Licensing Corporation, Boca Raton, Fla.

[21] Appl. No.: 08/890,286

[22] Filed: Jul. 9, 1997

Related U.S. Application Data

[63] Continuation of application No. 08/746,116, Nov. 6, 1996, abandoned, which is a continuation of application No. 08/631,697, Apr. 9, 1996, abandoned, which is a continuation of application No. 07/434,103, Nov. 9, 1989, Pat. No. 5,529,217.

[51] Int. Cl.[6] ..... B67D 5/60

[52] U.S. Cl. ..... 222/131; 222/211; 222/212; 222/214; 215/229

[58] Field of Search ..... 222/92, 105, 107, 222/175, 181.1–181.3, 183, 131, 206, 211–212, 214–215, 209, 158; 215/229, 11.1–11.6, 387–389

[56] References Cited

U.S. PATENT DOCUMENTS

| | | | |
|---|---|---|---|
| 1,199,772 | 10/1916 | Engel . | |
| 1,778,248 | 10/1930 | Doughty | 222/367 |
| 2,758,879 | 8/1956 | Anderson | 299/90 |
| 3,134,515 | 5/1964 | Callahan, Jr. | 222/211 |
| 3,156,383 | 11/1964 | Melli | 222/83 |
| 3,173,566 | 3/1965 | Talbet | 215/79 |
| 3,240,399 | 3/1966 | Frandeen | 222/211 |
| 3,871,555 | 3/1975 | Collins | 222/131 |
| 4,098,434 | 7/1978 | Uhlig | 222/94 |
| 4,196,817 | 4/1980 | Moser | 215/13 R |
| 4,293,084 | 10/1981 | Lussier | 222/158 |
| 4,428,508 | 1/1984 | Gardikas et al. | 222/153 |
| 4,457,455 | 7/1984 | Meshberg | 222/105 |
| 4,505,310 | 3/1985 | Schneider | 141/114 |
| 4,557,401 | 12/1985 | Hodge | 222/211 |
| 4,629,098 | 12/1986 | Eger | 222/175 |
| 4,708,254 | 11/1987 | Byrns | 215/13.1 |
| 4,785,974 | 11/1988 | Rudick et al. | 222/211 X |
| 4,883,205 | 11/1989 | Saelens et al. | 224/32 R |
| 4,892,230 | 1/1990 | Lynn, Jr. | 222/105 |
| 4,911,315 | 3/1990 | Shrum | 215/229 |
| 4,928,848 | 5/1990 | Ballway | 220/444 |
| 4,984,707 | 1/1991 | Fierthaler | 220/412 |
| 5,048,705 | 9/1991 | Lynd et al. | 222/211 X |
| 5,221,016 | 6/1993 | Karpal | 222/211 X |
| 5,316,193 | 5/1994 | Heiberger | 222/215 X |
| 5,494,198 | 2/1996 | Heiberger | 222/215 X |
| 5,529,217 | 6/1996 | Siegel | 222/211 X |

FOREIGN PATENT DOCUMENTS 536152 5/1941 United Kingdom .

*Primary Examiner*—Kenneth Bomberg
*Attorney, Agent, or Firm*—Cahill, Sutton & Thomas P.L.C.

[57] ABSTRACT

A squeezable, insulated drink bottle includes a flexible, semi-rigid, plastic beverage container that fits inside of and in spaced relationship to a flexible, semi-rigid plastic housing. An inwardly oriented flange around a top opening of the housing locks into a groove under a cover shoulder of the beverage container. Recesses in the housing facilitate gripping of drink bottle.

12 Claims, 2 Drawing Sheets

SQUEEZE BOTTLE WITH INSULATING JACKET

This is a continuation of patent application Ser. No. 08/746,116, originally filed Nov. 6, 1996, by GERALD SIEGEL, and entitled "SQUEEZE BOTTLE WITH INSULATING JACKET", which is a continuation of Ser. No. 08/631,697, filed Apr. 9, 1996 entitled "SQUEEZE BOTTLE WITH INSULATING JACKET", both now abandoned; which is a continuation of Ser. No. 07/434,103, filed Nov. 9, 1989, for a "SQUEEZE BOTTLE WITH INSULATING JACKET", now U.S. Pat. No. 5,529,217, issued Jun. 25, 1996.

BACKGROUND OF THE INVENTION

The invention relates to squeezable semi-rigid plastic "drink bottles" for storing water, juice, or the like with nozzles through which the liquid can be ejected by squeezing the bottle. The invention relates more particularly to an insulative housing for such a drink bottle.

Squeezable "drink bottles" formed of semi-rigid plastic material, with nozzles through which stored liquid can be ejected by squeezing the body of the bottle, or sucking through the nozzle or straw, have become very popular in recent years. Such drink bottles are commonly sold either alone or filled with ice and a beverage such as a soft drink. Typically, the cost of the drink bottle might be $1.00 and the cost of the bottle filled with ice and beverage might be $1.49, with additional refills of ice and beverage being available for $0.49 each. Such drink bottles typically are composed of high density polyethylene plastic material, the wall thickness of which is approximately 0.015 inches. The thermal insulation properties of the plastic wall are poor, so the ice will melt much faster on a warm day than is desirable. Such drink bottles frequently are re-used many times by re-filling them with ice and water, juice, or soft drink for use at sporting events, on hikes, on bicycle rides, etc. The market for such drink bottles requires that they be inexpensive. Because of this requirement, until now no one has been able to provide a practical, effective, insulative housing for squeezable "drink bottles" other than thick opaque foam sleeves or the like.

Various kinds of art work, such as company trademarks and logos, and graphic designs are commonly silk screened onto the outer surface of drink bottles. It is not practical to provide the desirable range of artwork on the above-mentioned insulative sleeves.

There is an unmet need for an inexpensive, thermally insulative housing for a semi-rigid, flexible, plastic squeezable drink bottle, which is compatible with the artwork that is required to make an aesthetically pleasing product.

SUMMARY OF THE INVENTION

Accordingly, it is an object of the invention to provide an inexpensive, thermally insulated, squeezable beverage bottle or drink bottle that allow application of a wide variety of detailed artwork, either screened on or applied as thermage labels, on various surfaces thereof.

It is another object of the invention to provide an inexpensive, thermally insulated, squeezable plastic beverage bottle that allows considerable flexibility in applying of art work, including art work with "three-dimensional effects", to the bottle.

Briefly described, and in accordance with one embodiment thereof, the invention provides an insulated, squeezable drink bottle including a plastic inner beverage container having a cover supporting a liquid delivery tube, and a flexible, squeezable, plastic, insulative housing. The beverage container fits inside and in spaced relationship to the housing to maintain a constant insulative air gap region between the outer surface of the beverage container and the inner surface of the housing. An upper edge feature of the housing mates with a corresponding feature of the upper portion of the beverage container. In one embodiment, an inwardly oriented flange of the housing locks into a mating groove under an upper shoulder of the beverage container, and recesses in the housing which serve to facilitate gripping the drink bottle also help maintain the air gap spacing between the housing and the beverage container. In one embodiment a liquid delivery tube (which also can serve as a straw) is supported in a cover of the beverage container. Squeezing of the insulative housing results in squeezing the beverage container, forcing fluid out through the delivery tube.

DETAILED DESCRIPTION OF THE PREFERRED EMBODIMENTS

Figure 1:
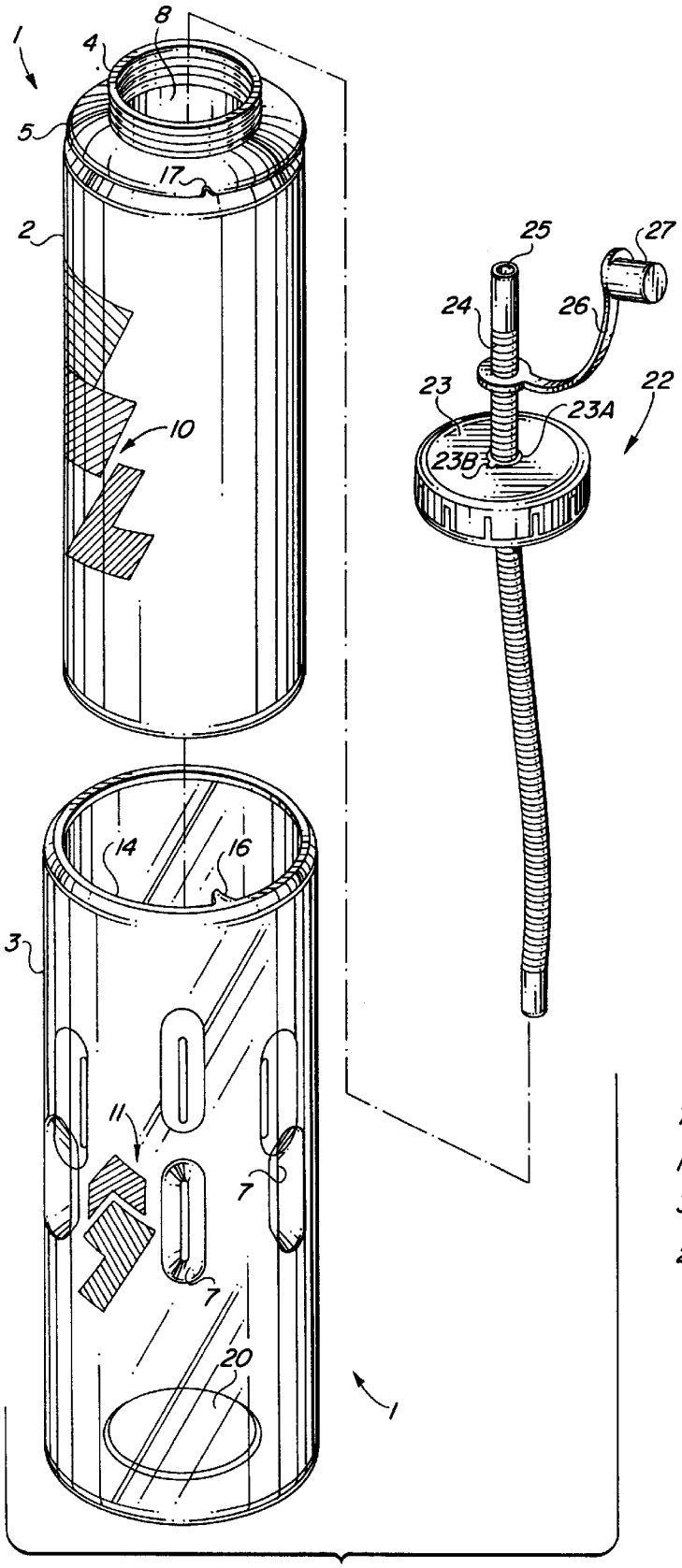
FIG. 1 is an exploded perspective view of a drink bottle.
Figure 2:
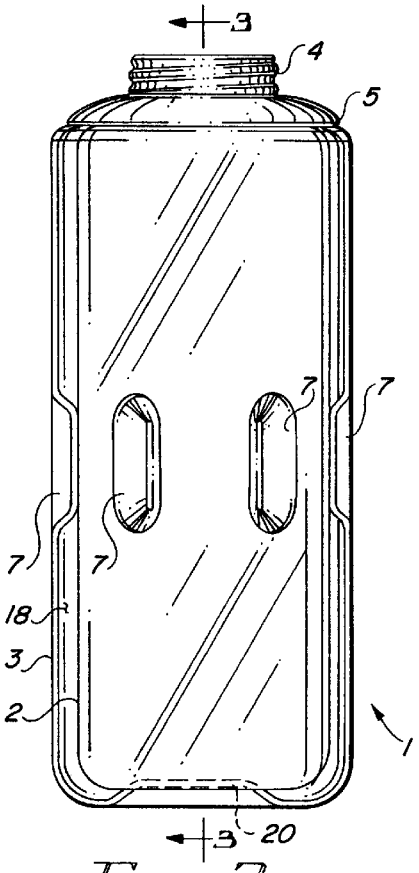
FIG. 2 is an elevation view of the beverage container and insulative housing of the drink bottle of FIG. 1.
Figure 3:
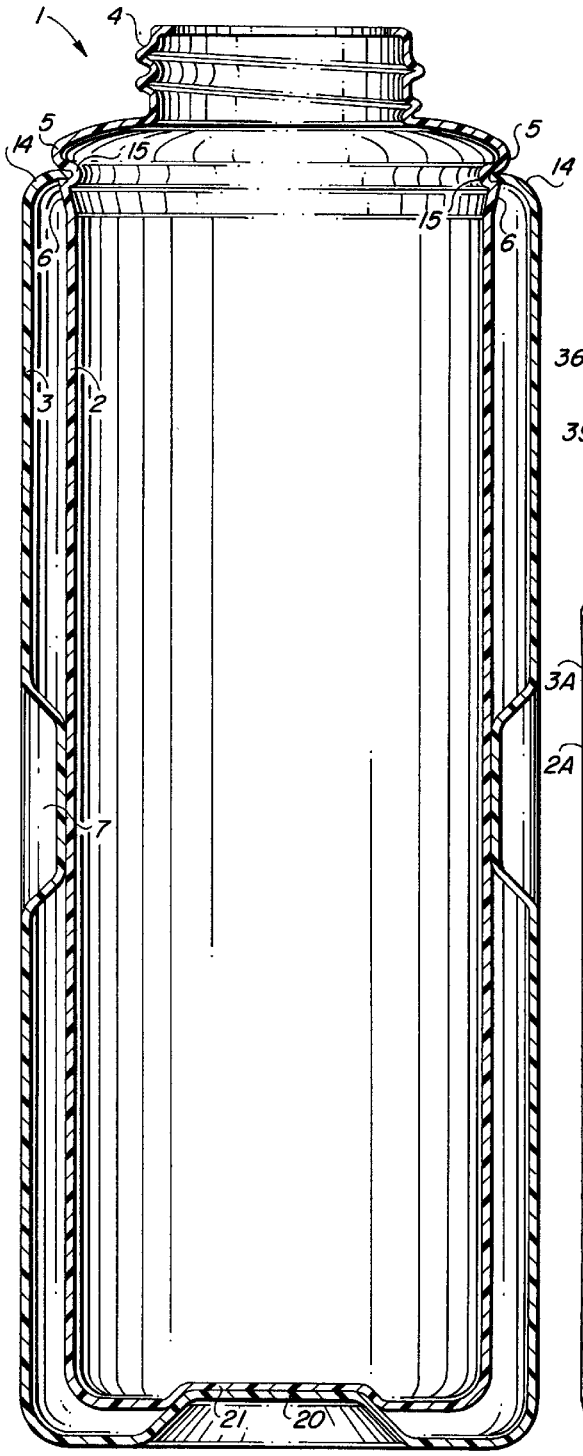
FIG. 3 is a section view along section line 3—3 of FIG. 2.

Referring to FIGS. 1–3, squeezable drink bottle 1 includes a beverage container 2 composed of semi-rigid, flexible plastic material, such as high density polyethylene (HDPE), having a wall thickness of approximately 0.015 inches. Beverage container 2 fits inside a transparent, semi-rigid, flexible insulative housing 3, composed of polyvinylchloride (PVC) plastic material, the wall thickness of which is approximately 0.018 inches.

Insulative housing 3 includes an inwardly oriented flange or lip 14, the edge of which locks into a groove 15 (FIG. 3) to provide the insulated squeezable drink bottle shown in FIG. 2.

An optional raised portion 20 in the bottom of housing 3 fits into a matching recess in the bottom of beverage container 2 to help keep the lower portion of beverage container 2 centered in housing 3, so as to maintain a constant, insulative air gap between the outer surface of beverage container 2 and the inner surface of insulative housing 3. A plurality of recesses 7 in housing 3 extend inward to touch or nearly touch the outer surface of beverage container 2, to maintain the insulative air gap. Recesses 7 also aid in gripping the drink bottle. In a prototype of the embodiment of FIGS. 1 and 2, beverage container 2 holds 32 ounces, and has a height of 9½ inches and a diameter of 3 inches. The insulative housing 3 has a height of 8⅝ inches and a outside diameter of approximately 3½ inches. The air gap 18 is approximately one-fourth of an inch between the vertical walls of beverage container 2 and insulative housing 3.

FIG. 3 shows details of the interlocking between insulative housing 3 and beverage container 2, wherein an outwardly sloped portion 6 of the upper vertical wall of container 2 bounds the lower side of groove 15, and rib or shoulder 5 bounds the upper side of groove 15. The diameter of the opening at the top of housing 3 is 3⅛ inches, which is only slightly greater than the outside diameter of the vertical walls of beverage container 2. The sloped portion 6 increases in diameter so as to form the lower wall of groove 15. Groove 15 is roughly a thirty-second of an inch deep.

The raised portion 20 of the bottom of housing 3 maintains an insulative air gap between the bottoms of beverage container 2 and housing 3.

A threaded mouth 4 of container 2 surrounding opening 8 receives a threaded cover 22, shown in FIG. 2. A flexible, ribbed drinking tube approximately 5/16 of an inch in diameter extends through a hole 23A in the top of cover 22, and can serve as a straw. The open end 25 of drinking tube 24 can be covered by a plastic cap 27 connected by a strap 26 to the tube 24. A user typically would squeeze the flexible housing 3 inward far enough to also squeeze flexible beverage container 2, forcing fluid out of tube 24 into the mouth of the user. Air hole 23B allows outside air to replace fluid ejected or sucked through tube 25.

In FIG. 1, numeral 10 designates various indicia provided on the outer surface of the inner beverage container 2. Drink bottles of the prior art commonly have screened-on artwork, which is important to merchandising. By making the insulative housing 3 of transparent plastic, all of the inner artwork 10 is completely visible. Furthermore, indicia, such as that indicated by numeral 11 in FIG. 1 can be screened on the surface of transparent insulative housing 3. A suitable tab 16 on the lip 14 of housing 3 can be provided to mate with a corresponding recess feature 17 on the upper shoulder of beverage container 2 to keep the indicia 11 on housing 3 properly aligned with indicia 10 on the surface of the beverage container 2. This may be desirable so that the indicia 11 do not interfere with viewing of the indicia 10. Such fixed alignment also makes it possible to provide three-dimensional visual effects involving inner indicia 10 and outer indicia 11.

Figure 4A:
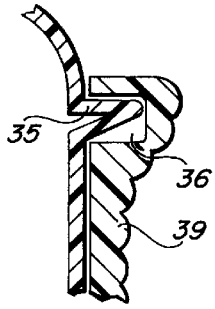
FIG. 4A is an enlarged view of detail 4 of FIG. 4.
Figure 4:
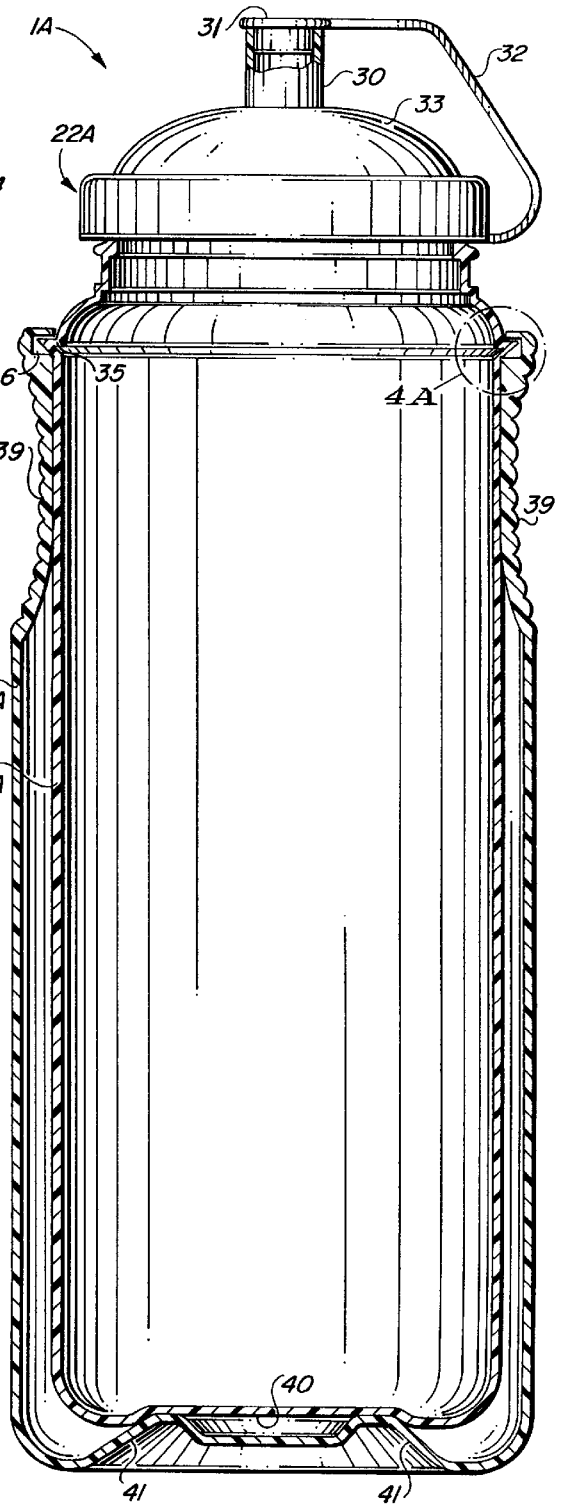
FIG. 4 is a section view of an alternate embodiment of the invention.

Alternately, the type of top shown in the embodiment of FIG. 4 can be utilized, wherein a delivery tube 30 extends from the top of cover 33, and a push-pull stopper 31, which is connected by a flexible strap 32 to the base of cover 33, can be utilized to seal the delivery tube 30.

In the embodiment of FIG. 4, the upper portion of housing 3A includes a ribbed surface 39 that is recessed so that the adjacent inner surface of housing 3A touches or nearly touches the outer surface of beverage container 2A. A circumferential flange 35 (FIG. 4A) is formed in the wall of container 2A and snaps into an annular recess 36 just below the top opening of housing 3A. This embodiment of the invention is more easily gripped by means of the ribbed recessed band 39.

Both of the above-described embodiments permit the inner beverage container to be squeezed easily by merely squeezing the outer insulative housing, and therefore provide all the benefits of prior squeezable drink bottles, while also providing effective thermal insulation which allows ice to last much longer, keeping beverages cold much longer, and allows versatile use of detailed graphics on the beverage container 2, and also the housing 3. The above embodiments of the invention have been found to increase the life of ice inside the drink bottle by approximately 50%.

While the invention has been described with reference to several particular embodiments thereof, those skilled in the art will be able to make the various modifications to the described embodiments of the invention without departing from the true spirit and scope of the invention.

What is claimed is:

1. A thermally insulated drink bottle, comprising in combination:

(a) an inner container having an openable cover disposed at one end, said inner container being composed of semi-rigid collapsible plastic;

(b) a liquid delivery tube supported by said cover to deliver liquid from said inner container;

(c) an outer container of larger diameter than said inner container, said outer container having a top opening into which said inner container slideably fits and being composed of semi-rigid collapsible plastic; and (d) an interconnection for engaging said inner container in fixed relationship to said outer container to maintain a space between said inner and said outer containers, said interconnection including an annular depression disposed about said inner container and an annular element extending radially inwardly from said outer container for engaging said annular depression.

2. The thermally insulated drink bottle set forth in claim 1 wherein said outer container is of transparent material.

3. The thermally insulated drink bottle set forth in claim 2 including indicia imprinted on an outer surface of said inner container.

4. The thermally insulated drink bottle set forth in claim 1 wherein said annular element is disposed at the perimeter of the opening of said outer container.

5. The thermally insulated drink bottle set forth in claim 3 including means for aligning said outer container with said inner container to prevent coaxial rotation of said inner container relative to said outer container and thereby maintain a fixed relationship between the indicia on said inner container with any indicia on said outer container.

6. The thermally insulated drink bottle set forth in claim 1 wherein said annular depression comprises a groove disposed in said inner container and wherein said annular element comprises an inwardly oriented lip disposed at the opening of said outer container and including a ramp disposed adjacent said groove on a side of said groove opposite from said cover, whereby when said inner container is forced into said outer container through the opening, said lip encounters said ramp, slides over it, and snaps into said groove.

7. An insulated squeezable drink bottle, comprising in combination:

(a) an inner container having an openable top cover, said inner container being composed of plastic;

(b) a liquid delivery tube supported by said cover to deliver liquid from said inner container;

(c) an outer container of larger diameter than said inner container, said outer container having a top opening into which said inner container slideably fits, said outer container being composed of plastic;

(d) an interconnection for engaging said inner container in fixed relationship to said outer container to maintain a constant insulative air gap between said inner and said outer containers; and (e) a plurality of recesses in said outer container to ease gripping said drink bottle and extending to said inner container to maintain the spacing of the insulative air gap.

8. The insulated squeezable drink bottle set forth in claim 7 including means for aligning said outer container with said inner container to prevent coaxial rotation of said inner container relative to said outer container and thereby maintain a fixed relationship between the indicia on said outer container and the indicia on said inner container.

9. The insulated squeezable drink bottle set forth in claim 7 wherein said interconnection includes a groove in an upper cylindrical shoulder portion of said inner container and an inwardly oriented flange bounding the top opening of said outer container, a lower portion of said groove being bounded by a sloped upper portion of a cylindrical wall of said inner container, whereby when said inner container is forced into said outer container through the top opening, said flange encounters said sloped surface, slides over it, and snaps into said groove.

10. The insulated squeezable drink bottle set forth in claim 7 wherein said outer container is of transparent material.

11. The insulated squeezable drink bottle set forth in claim 10 including indicia imprinted on an outer surface of said inner container.

12. The insulated squeezable drink bottle set forth in claim 11 including indicia imprinted on an outer surface of said outer container.

* * * * *